US005606869A

United States Patent [19]

Joo

[11] Patent Number: 5,606,869

[45] Date of Patent: Mar. 4, 1997

[54] CYLINDRICAL ICE CUBE MAKER

[76] Inventor: Sung I. Joo, 1729 N. Gilbert St., Fullerton, Calif. 92833

[21] Appl. No.: 628,077

[22] Filed: Apr. 8, 1996

[51] Int. Cl.[6] ..... F25C 1/18

[52] U.S. Cl. ..... 62/347; 62/70; 62/352

[58] Field of Search ..... 62/347, 352, 353, 62/70, 73

[56] References Cited

U.S. PATENT DOCUMENTS

| | | | |
|---|---|---|---|
| 2,718,123 | 9/1955 | Braswell, Jr. | 62/352 |
| 3,197,974 | 8/1965 | Smith | 62/320 |
| 3,206,944 | 9/1965 | Gallo | 62/347 |
| 3,318,106 | 5/1967 | Litman | 62/347 |
| 3,404,543 | 10/1968 | Diblick | 62/353 |
| 3,984,996 | 10/1976 | Bright | 62/353 |
| 4,429,543 | 2/1984 | Fischer | 62/73 |
| 4,510,761 | 4/1985 | Quarles | 62/352 |
| 4,589,261 | 5/1986 | Ohashi | 62/73 |
| 4,732,006 | 3/1988 | Fischer | 62/353 |
| 4,753,081 | 6/1988 | Koeneman | 62/69 |

*Primary Examiner*—William E. Tapolcai
*Attorney, Agent, or Firm*—Eugene Oak, J.D

[57] ABSTRACT

An ice maker which produces clean, crescent-shaped ice pieces. A threaded cylindrical evaporator surrounded by copper tubing and having a centrally mounted driver with fins freezes water into crescent-shaped ice pieces and dispenses them from a chute at the top of the evaporator. Two embodiments of the present invention are provided.

14 Claims, 5 Drawing Sheets

CYLINDRICAL ICE CUBE MAKER

FIELD OF THE INVENTION

The present invention generally relates to an apparatus which produces ice pieces, particularly to an apparatus which mass produces clear, crescent-shaped ice pieces.

BACKGROUND OF THE INVENTION

Many ice cube making devices exist on the market today. Among these are Fischer U.S. Pat. No. 4,429,543, Koeneman et al. U.S. Pat. No. 4,753,081, Ohashi et al., U.S. Pat. No. 4,589,261, Gallo U.S. Pat. No. 3,206,944, and D. C. Smith et al U.S. Pat. No. 3,197,974 to D. C. Smith et al. All of these inventions are related in some way to the production of ice, ice cubes, or ice chips. The closest in nature to the present invention is Fischer U.S. Pat. No. 4,429,543, which discloses an ice maker. Although Fischer's invention appears to function similarly to the present invention, the present invention possesses distinct advantages over the prior art which will be pointed out in more particularity later.

Thus, there is presently a need for the novel features possessed by the present invention.

BRIEF SUMMARY OF THE INVENTION

The present invention is a relatively space-saving ice maker which produces clear, crescent-shaped ice pieces.

Crescent-shaped ice pieces are formed by circulating a refrigerant through a helical tubing section while water is supplied to the interior of a vertically-disposed cylindrical threaded evaporator wrapped by the helical tubing section. Upon achievement of a desired thickness of ice, the refrigerant is discontinued and the tubing section is heated to break the ice bond between the newly-formed ice and the evaporator. A dividing driver is actuated to rotate the crescent-shaped ice pieces slidably within the interior surface of the evaporator, thereby harvesting the crescent-shaped ice pieces. The driver is formed of synthetic resin and is disposed on the axial center line of the evaporator. The crescent cube ice is slidably rotated upward so as to dispense the crescent-shaped ice pieces from a chute at the top of the evaporator.

These together with other objects-of the invention are pointed out clearly in the claims annexed to and forming a part of this disclosure. For a better understanding of the present invention, its operating advantages and the specific objects attained by its use, references should be made to the accompanying drawings and descriptive matter in which there are illustrated preferred embodiments of the invention.

BRIEF DESCRIPTION OF THE DRAWINGS

For a better understanding of the nature of the present invention, reference should be made to the following detailed description taken in connection with the accompanying drawings wherein.

DETAILED DESCRIPTION OF THE PREFERRED EMBODIMENT

Figure 1:
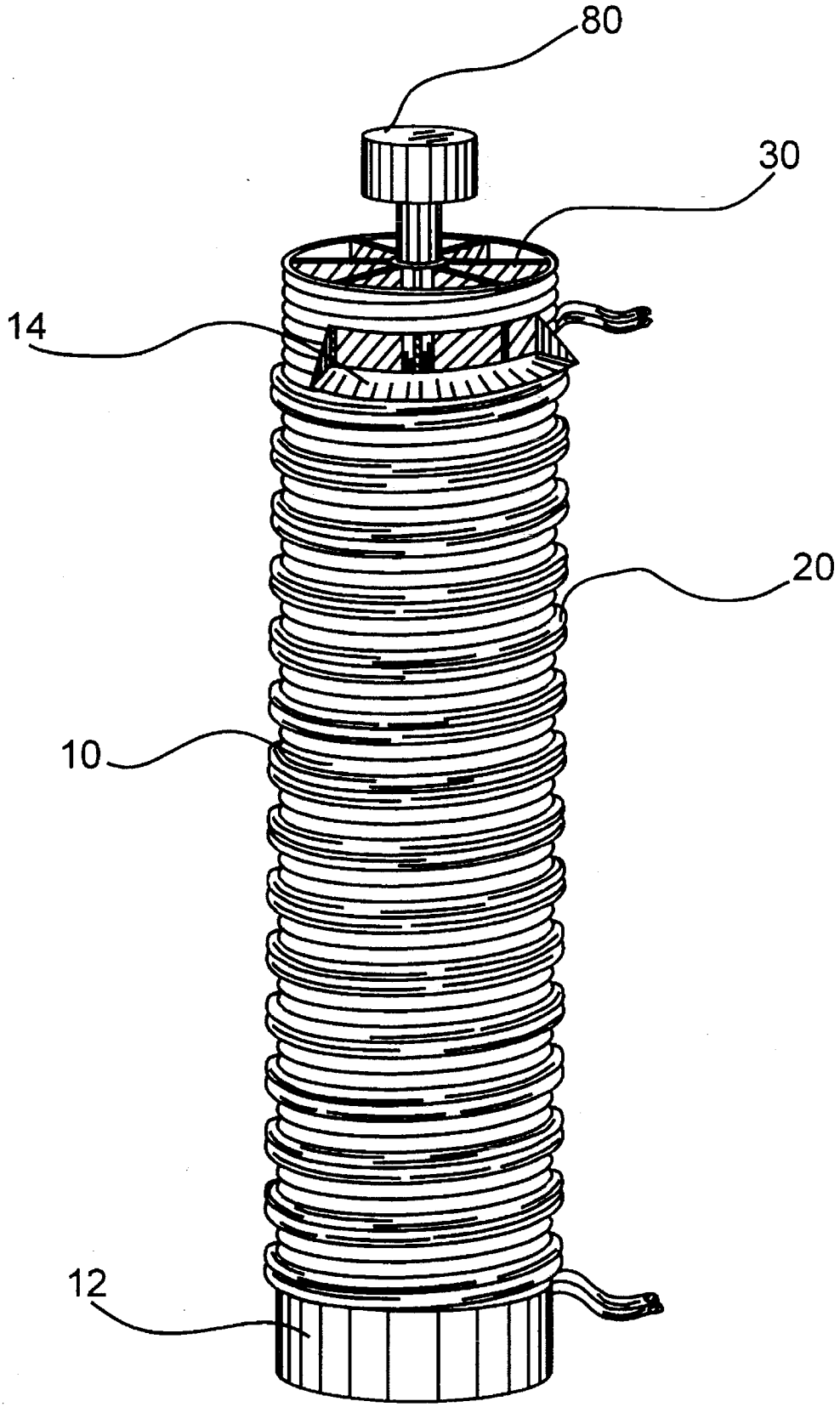
FIG. 1 is a perspective view of the present invention.

Referring now to FIG. 1, the preferred embodiment of the present invention comprises a vertically-disposed cylindrical threaded evaporator, generally referred to as 10, with water being supplied to the inner surface thereof. The evaporator 10 is composed of stainless steel and is wrapped by a helical tubing section composed of copper, generally referred to as 20, which follows the outer thread of the evaporator. This tubing section 20 can either be a single tube, as shown in FIG. 4*a*, or dual adjacent tubes, as shown in FIG. 4*b*, depending upon the size of ice pieces desired. A low boiling liquid refrigerant is supplied to the interior of the tubing section 20 and circulated therethrough. The evaporating refrigerant takes up heat from the water within the evaporator 10 causing crescent-shaped ice pieces 50, shown in FIG. 3*b*, to form on the interior surface of the evaporator. The crescent-shaped ice pieces 50 are separated by an axially disposed rotatable driver, generally referred to as 30. The driver 30 is powered by an electric gear motor 80 which can be positioned above, below, or within the evaporator 10.

When the crescent-shaped ice pieces 50 reach the desired thickness, the supply of refrigerant to the tubing section is halted and hot gas is supplied to the tubing section, heating the tubing section so as to break the thermal bond between the crescent-shaped ice pieces 50 and the inner surface of the evaporator 10. The driver 30 is then rotated causing the crescent-shaped ice pieces to travel upward in sliding contact with the inner surface of the evaporator. The leading crescent-shaped ice pieces are dispensed from a chute 14 located near the top of the evaporator 10.

Figure 2:
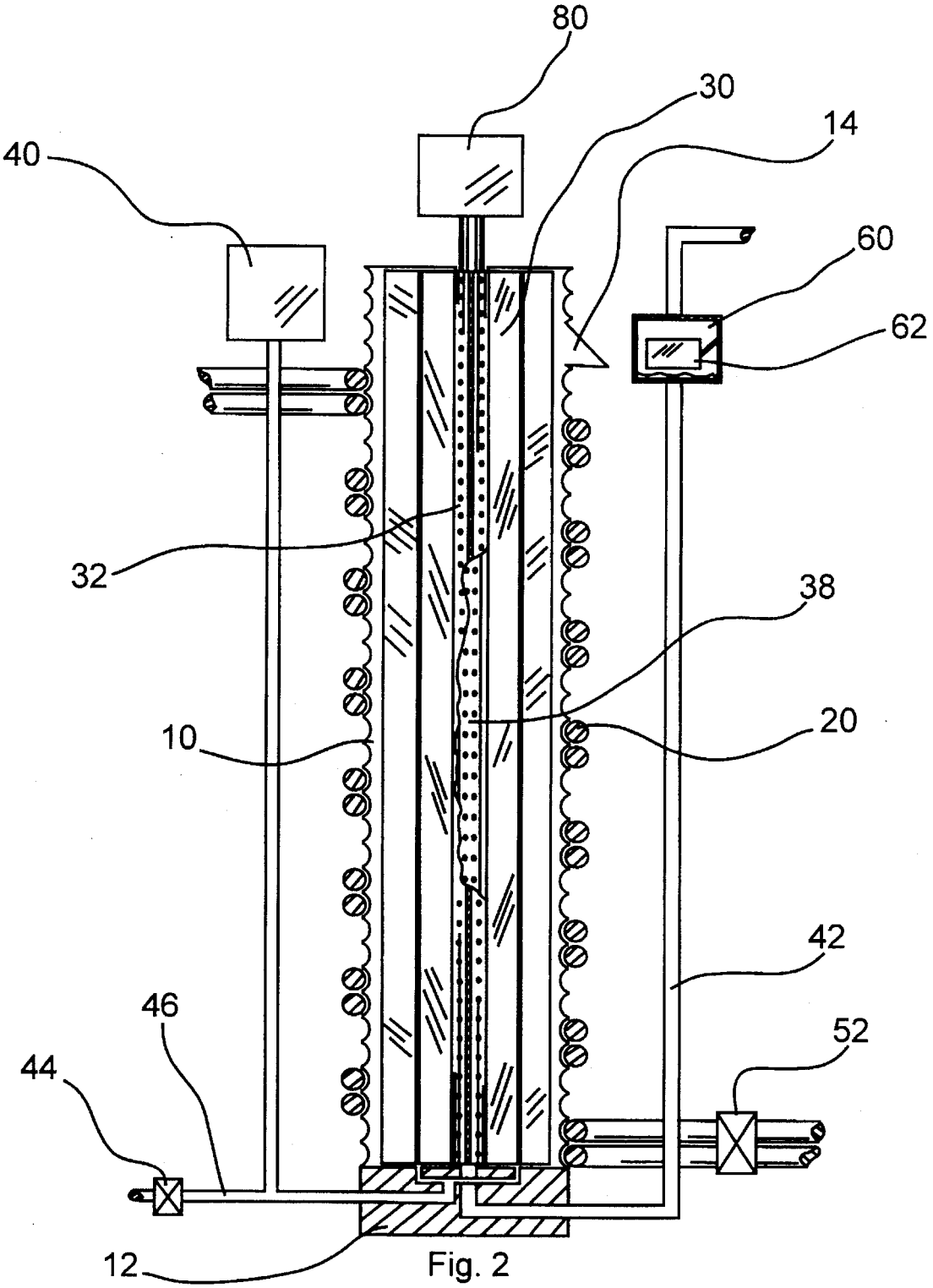
FIG. 2 is a cross-sectional view of the present invention.
Figure 3A:
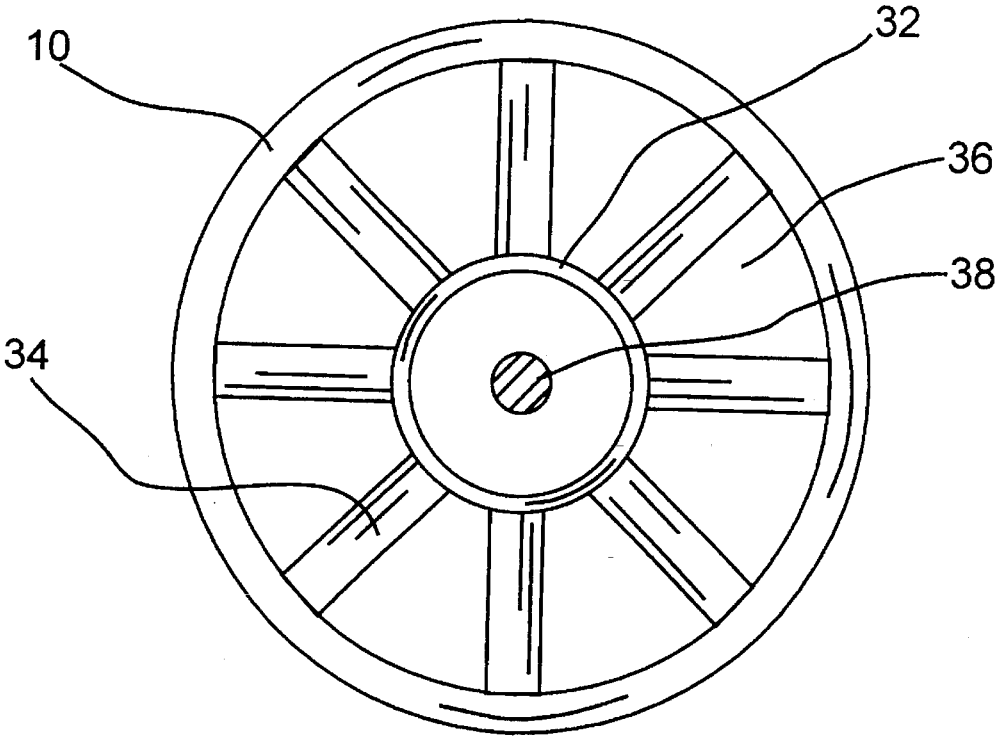
FIG. 3*a* is a top view of the present invention.

A top view of the invention, shown in FIG. 3*a*, shows vertical fins 34 protruding radially from the core 32 of the driver. The fins 34 extend from the vertical core 32 to the inner surface of the evaporator 10, effectively dividing the interior of the evaporator into equally-sized, separate chambers 36. The number of chambers 36 is equal to the number of fins 34, which may be modified according to preference. The vertical core 32 is covered with holes, as is a rod 38 within the vertical core. These are shown more clearly in FIG. 2. The rod 38 is connected to a remote water reservoir 60.

Water is transferred from the remote water reservoir 60 through an input tube 42 into the rod 38. Water passing through the input tube is controlled by a float valve 62. As the rod 38 is filled, water passes through the holes of the rod into the surrounding vertical core 32. As the vertical core 32 is filled, water passes through the holes of the vertical core into the surrounding vertical chambers 36. This process continues until all of the vertical chambers 36 are filled with water. The water level in the vertical chambers 36 of the evaporator 10 is synchronized to the water level in the remote reservoir 60. When the water level in the evaporator reaches a point just below the chute 14, a float valve 62 in the reservoir halts the flow of additional water, thereby preventing the water level within the evaporator 10 from reaching the chute 14.

The present invention operates on a cyclic basis wherein first freezing of the crescent-shaped ice pieces occurs, followed by heating to break the bond between the crescent-shaped ice pieces and the inner surface of the evaporator, followed by harvesting by rotating the crescent-shaped ice pieces upward until they are dispensed from the chute at the top of the evaporator. As a first step in the cycle, the control system opens the float valve 62 until the evaporator is filled with water. After the evaporator is full, the freezing cycle begins, during which the temperature of the refrigerant within the helical tubing 20 is lowered below the freezing point of water and beginning the build-up of a film of water ice on the inner surface of the evaporator.

Air agitation throughout the evaporator 10 is employed in order to produce clear ice instead of cloudy ice, and the flow of air is carried out continuously during the time when the ice-maker is operating. Air at the desired flow rate is supplied via a small electric motor-driven diaphragm pump or the like 40 which discharges through holes in the base of the evaporator.

Figure 3B:
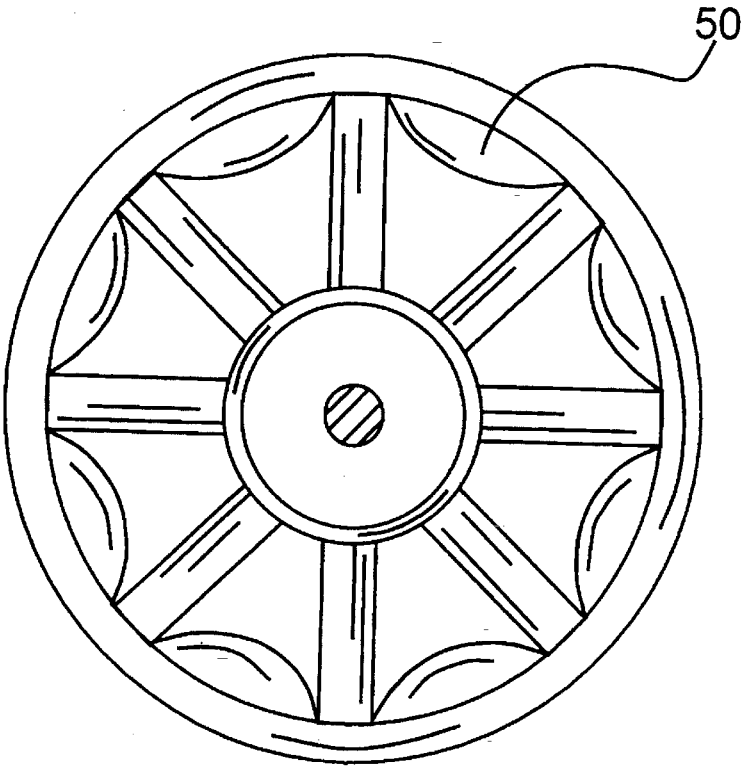
FIG. 3*b* is a top view of the present invention after its freezing cycle.
Figure 4A:
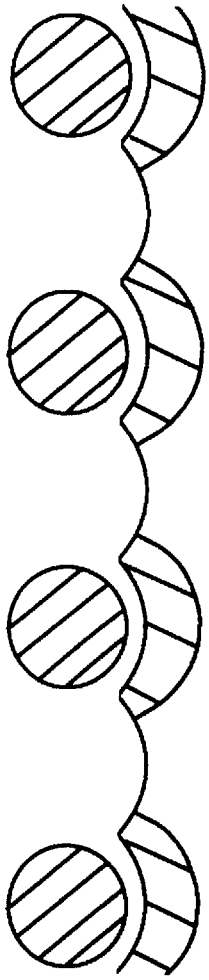
FIGS. 4*a* and 4*b* is a cross-sectional view of a wall of the present invention after its freezing cycle.
Figure 4B:
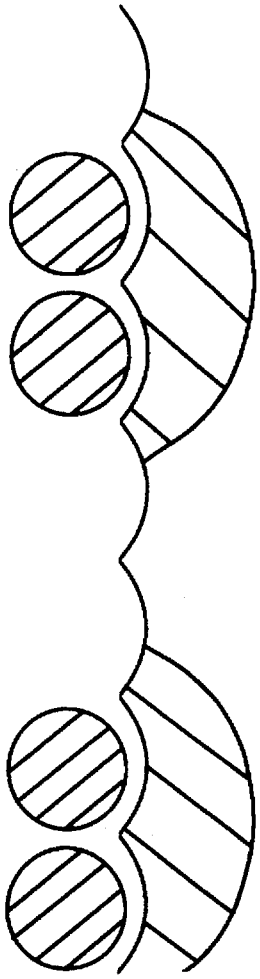

When the crescent-shaped ice pieces have been built up on the inner surface of the evaporator to the desired thickness, as illustrated in FIG. 3*b*, the defrosting cycle begins. The thickness of the ice can be determined using any of several different measurements well known in the art; however, it has been found preferable to maintain a timed operation whereby freezing is carried out for a pre-determined period of time. When the control system timer reaches the end of the set period, a signal is sent which opens the refrigerant solenoid-controlled valve 52. As a result, hot high-pressure gas is fed into the bottom of the helical tubing section 20 raising its temperature above 32 degrees Fahrenheit (0 degrees Celsius).

After the hot gas valve 52 has been open for a predetermined period of time, the bond between the crescent-shaped ice pieces 50 and the inner surface of the evaporator 10 has been broken so the ice helix is loose on the inner surface of the evaporator. The control system timer then energizes the electric gear motor 80 which in turn drives the central driver 30 and its radially extending fins 38. At the beginning of the defrosting cycle, a water drain valve 44 simultaneously opens and the unfrozen water is drained from the evaporator 10 through the holes in the top of the base 12. This water is then disposed of through a drain tube 46.

Because the crescent-shaped ice pieces 50 are now loose on the evaporator 10, each turn of the driver 30 screws the ice pieces 50 upward at a rate equal to the pitch of the helix. As soon as the water level within the evaporator 10 begins to drop as a result of the draining of water, the float valve 62 in the remote water reservoir 60 simultaneously opens the water supply line 42 and closes the hot gas valve 52. As a result, the evaporator begins to refill with water, and the flow rate permitted by the valve is such that, by the time the trailing edge of the ice pieces 50 have reached the chute 14, the level of water in the evaporator 10 has reached its initial position.

Following the closing of the hot gas valve 52, the following freezing cycle is ready to begin.

Figure 5:
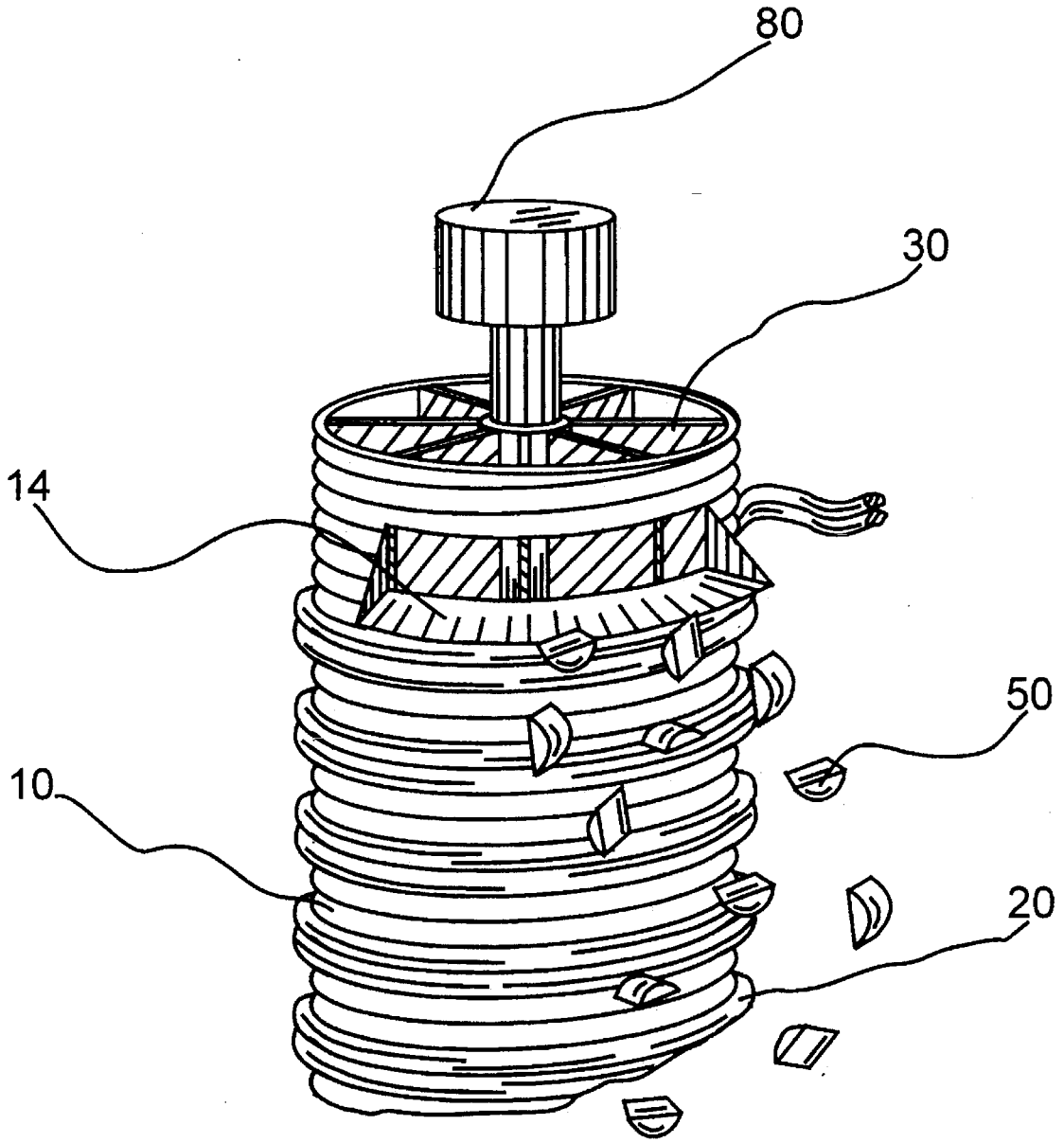
FIG. 5 is a perspective view of the present invention in its harvesting cycle.

FIG. 5 is a perspective view of the present invention in its harvesting cycle. The ice pieces 50 are dispensed from the evaporator 10 through the chute 14.

An alternate embodiment of the present invention produces ice in much the same way as the preferred embodiment while utilizing a water circulation method. All of the components used are the same as those of the preferred embodiment except that the remote water reservoir 60, float valve 62, air pump 40, and air tube 42 do not exist. In their stead are a water circulation tube and a water pump.

Particular features of the invention are emphasized in the claims which follow.

What is claimed is:

1. Ice-making apparatus which comprises threaded evaporator wrapped by a helical tubing section, elongated drive means located axially within said evaporator, means for supplying water to the interior surface of said evaporator, means for supplying refrigerant to said helical tubing section so that evaporation takes place within said helical section causing the freezing of crescent-shaped ice pieces on the interior surface of said evaporator, means for heating said tubing above the freezing point of water to free said sectional ice helix from its bond to said evaporator following discontinuation of supply of refrigerant thereto, and means for causing said drive means to rotate said crescent-shaped ice pieces and dispense the leading end of said ice pieces through a chute near the top of said evaporator.

2. Apparatus in accordance with claim 1 wherein said evaporator is positioned with its axis vertical and wherein said driver means includes a rotatable shaft located coaxially within said evaporator and having a plurality of radially extending fins for engaging the interior of said evaporator and means for causing said shaft to rotate about a vertical axis.

3. Apparatus in accordance with claim 2 wherein said fins are made from a synthetic resin material having a surface that resists formation of a strong ice bond thereto.

4. Apparatus in accordance with claim 3 wherein said fins divide said evaporator into a corresponding plurality of vertical chambers.

5. Apparatus in accordance with claim 2 wherein said shaft comprises an outer cylindrical body and inner cylindrical body.

6. Apparatus in accordance with claim 5 wherein said outer and inner cylindrical bodies have a plurality of holes.

7. Apparatus in accordance with claim 6 wherein said water supply means fills said inner cylindrical body, outer cylindrical body, and vertical chambers, respectively.

8. Apparatus in accordance with claim 7 wherein said water supply means fills said vertical chambers to a level just below said chute.

9. Apparatus in accordance with claim 8 wherein means is provided for supplying air to the base of said water filled evaporator during the time of said freezing so as to agitate said water and promote the formation of clear, crescent-shaped ice pieces.

10. Apparatus in accordance with claim 1 wherein draining water from said evaporator and circulating refrigerant through said helical tubing are regulated by means of respective solenoid valves.

11. Apparatus in accordance with claim 1 wherein adding water to the interior of said evaporator is regulated by means of a float valve.

12. Apparatus in accordance with claim 1 wherein said helical tubing section is a singular tube.

13. Apparatus in accordance with claim 1 wherein said helical tubing section are dual adjacent tubes.

14. An alternate embodiment of the present invention comprising an apparatus in accordance with claim 1 including:

a ring having a plurality of holes circumferentially installed just below said ice dispensing opening, a water basin installed at the base of said cylindrical body, a water pump connecting said base of said cylindrical body to said ring.

* * * * *